US006686709B2

(12) United States Patent
Lee et al.

(10) Patent No.: US 6,686,709 B2
(45) Date of Patent: Feb. 3, 2004

(54) DEFLECTION YOKE FOR A CRT

(75) Inventors: Seok Moon Lee, Kumi (KR); Jong Ho Lim, Taegu (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/124,246

(22) Filed: Apr. 18, 2002

(65) Prior Publication Data

US 2002/0190630 A1 Dec. 19, 2002

(30) Foreign Application Priority Data

Jun. 9, 2001 (KR) ..... P2001-32231

(51) Int. Cl.[7] ..... H01J 29/56; H01J 29/76
(52) U.S. Cl. ..... 315/370; 313/440
(58) Field of Search ..... 315/370, 371, 315/400, 391, 368.11, 13 C; 313/440, 477 R, 442; 335/212, 211

(56) References Cited

U.S. PATENT DOCUMENTS

| | | | | | |
|---|---|---|---|---|---|
| 3,800,176 | A | * | 3/1974 | Gross et al. | 313/403 |
| 3,892,996 | A | * | 7/1975 | Morrell et al. | 313/413 |
| 4,229,720 | A | | 10/1980 | Heijnemans et al. | 335/213 |
| 5,115,170 | A | * | 5/1992 | Ose et al. | 315/370 |
| RE35,183 | E | * | 3/1996 | Ose et al. | 315/370 |
| 5,763,995 | A | * | 6/1998 | Sano et al. | 313/477 R |
| 6,087,767 | A | * | 7/2000 | Sano et al. | 313/440 |
| 6,208,068 | B1 | | 3/2001 | Lee et al. | 313/477 R |
| 6,211,610 | B1 | * | 4/2001 | Nakajima | 313/440 |
| 6,404,119 | B1 | * | 6/2002 | Hidaka et al. | 313/477 R |
| 6,452,321 | B1 | * | 9/2002 | Kojima | 313/440 |

FOREIGN PATENT DOCUMENTS

| | | |
|---|---|---|
| EP | 0240079 | 10/1987 |
| EP | 1102301 A1 | 5/2001 |
| JP | 48-34349 | 10/1973 |
| JP | 56-63757 | 5/1981 |
| JP | 02-123646 A | 5/1990 |
| JP | 08-007792 | 1/1996 |
| JP | 11-265668 | 9/1999 |
| JP | 2000-294165 | 10/2000 |

* cited by examiner

*Primary Examiner*—Don Wong
*Assistant Examiner*—Chuc Tran
(74) *Attorney, Agent, or Firm*—Fleshner & Kim, LLP

(57) ABSTRACT

A deflection yoke is provided for a CRT, which includes horizontal and vertical deflection coils that deflect electron beams emitted from an electron gun in a horizontal or vertical direction, a ferrite core that reduces a loss of magnetic force caused by the horizontal and vertical deflection coils thereby enhancing magnetic efficiency, and a holder that holds the horizontal deflection coils, the vertical deflection coils, and the ferrite core at required positions, and provides insulation between the horizontal deflection coils and the vertical deflection coils. The horizontal and/or vertical deflection coils have a substantially rectangular shape on a screen side, and the ferrite core is circular or elliptical. This reduces material costs and reduces convergence and distortion errors, because a dimensional distribution of an inside surface area of the ferrite core is reduced with respect to related art deflection yokes, and polishing of an inside surface becomes easier. This significantly improves production yield and the dimensional distribution of the ferrite core.

24 Claims, 8 Drawing Sheets

DEFLECTION YOKE FOR A CRT

BACKGROUND OF THE INVENTION

1. Field of the Invention

The invention relates to a deflection yoke for a cathode ray tube (CRT), more particularly, a color CRT.

2. Background of the Related Art

An in-line type electron gun generally used in a color CRT has red 'R', green 'G', and blue 'B' color electron beams arranged horizontally in a line. A self-converging type deflection yoke is required in the CRT to converge the three electron beams onto one point on a fluorescent surface using a non-uniform magnetic field.

FIG. 1 of the present application shows a related art color CRT. The color CRT of FIG. 1 is provided with a panel 1 at a front of the CRT. A fluorescent surface 3 formed of red R, green G, and blue B fluorescent materials is coated on an inside surface of the panel 1. A shadow mask 2 is positioned adjacent the fluorescent surface 3 and selects a color of the electron beams incident on the fluorescent surface. A funnel 6 is attached to the back of the panel 1 and provides an inner space under vacuum. An electron gun 5 is fitted inside a tubular neck part of the funnel and emits the electron beams. A deflection yoke 4 is provided around an outer circumference of the funnel 6. The deflection yoke 4 deflects the electron beams in the horizontal or vertical direction.

Referring to FIG. 2, the deflection yoke 4 is provided with one pair of horizontal deflection coils 41 that deflect the electron beams emitted from the electron gun 5 inside of the CRT in a horizontal direction, one pair of vertical deflection coils 42 that deflect the electron beams in a vertical direction, and a ferrite core 44 that reduces a loss of magnetic force caused by currents in the horizontal and vertical deflection coils. A holder 43 fixes the physical relative positions, fastens, and couples the horizontal deflection coils, the vertical deflection coils, and the ferrite core, provides insulation between the horizontal deflection coils and the vertical deflection coils, and facilitates coupling of the yoke 4 to the CRT. A COMA free coil 45 fitted to a neck side of the holder improves a COMA aberration caused by a vertical barrel type magnetic field. A ring band 46 fitted to the neck side of the holder mechanically couples the CRT with the deflection yoke. Magnets 47 fitted to an open end of the deflection yoke correct a raster distortion (hereafter called distortion) on the picture.

The horizontal deflection coils of the deflection yoke 4 include upper and lower deflection coils connected in parallel, as shown in FIG. 3B. A horizontal deflection current, as shown in FIG. 3A, is applied to the upper and lower deflection coils to form a horizontal deflection magnetic field, which deflects the electron beams from the electron gun 5 in the horizontal direction.

The deflection yoke 4 may be categorized depending on the shapes of the horizontal and vertical deflection coils 41 and 42, and the ferrite core 44, as set forth in table 1 below. That is, as shown in FIGS. 4 and 5, if the horizontal and vertical deflection coils are circular, the ferrite core is circular. As shown in FIG. 6, if the horizontal and the vertical deflection coils 41 and 42 are rectangular, the ferrite core is rectangular.

TABLE 1

| Kind of DY | Horizontal DY | Vertical DY | Ferrite core |
|---|---|---|---|
| Circular DY | Circular coil | Circular coil | Circular core |
| RAC DY | Rectangular coil | Rectangular coil | Rectangular core |

*DY: deflection yoke

Since the RAC type CRT deflection yoke 4 has a rectangular deflection coil and ferrite core, in the RAC type CRT deflection yoke 4 there is a shorter distance to the electron beams compared to the circular deflection yoke 4, which provides better deflection sensitivity.

In general, the related art deflection yoke 4 has a current having a frequency equal to, or higher than, 15.75 KHz flowing through the horizontal deflection coil 41. This current deflects the electron beams in the horizontal direction using a magnetic field formed as the current flows through the horizontal deflection coil 41. The related art deflection yoke 4 generally has a current having a frequency equal to 60 KHz flowing through the vertical deflection coil 42. This current deflects the electron beams in a vertical direction using a magnetic field formed as the current flows through the vertical deflection coil 42.

In most cases, a self-convergence type deflection yoke 4 is used, in which the three electron beams are converged on the screen using a nonuniform magnetic field formed by the horizontal and vertical deflection coils without providing additional circuitry and device(s). That is, distributions of the windings of the horizontal deflection coil and the vertical deflection coil are adjusted to form a barrel or pin-cushion type magnetic field at respective parts (the opening part, the middle part, and the neck part) of the CRT so that the three electron beams undergo different deflection forces according to the positions of the three electron beams to converge the electron beams from different starting points to the same arrival point on the screen 1.

If the magnetic field formed by the current through the deflection coil is not adequate for deflecting the electron beams to all parts of the screen, the ferrite core 44, which has high permeability, is employed to minimize the loss of the magnetic field on the returning path, and to enhance a magnetic field efficiency and force.

Referring to FIG. 7, each of the one pair of horizontal deflection coils 41 has a rectangular upper horizontal deflection coil and a lower horizontal deflection coil, connected in parallel as shown in FIG. 3B, in which horizontal deflection currents in a saw tooth form are formed, forming a pin-cushion type horizontal deflection magnetic field.

There are two kinds of deflection yokes. As shown in FIGS. 4 and 5, since a circular deflection yoke 4, with circular horizontal and vertical deflection coils 41 and 42 and a circular ferrite core 44, has a ratio of inside surface areas of the neck part to the opening part of at least greater than 10 times, a deflection center of the deflection coil is deviated toward the neck part. Thus, it is necessary to arrange the deflection yoke inclined toward the screen in order to avoid a BSN (Beam Strike Neck) characteristic, a phenomenon in which the electron beams from the electron gun land on an inside surface of the funnel, which results in poor deflection sensitivity.

As shown in FIGS. 6 and 7, the RAC type deflection yoke 4, with rectangular horizontal and vertical deflection coils 41 and 42, and a rectangular ferrite core 44, deflects electron beams in the horizontal direction by a force inversely proportional to a third power of a distance between an inside surface of the horizontal deflection coil and the electron beams, according to Flemming's left hand rule, as the three electron beams (i.e., red, green, and blue) from the electron gun 5 pass through the horizontal deflection magnetic field. Accordingly, the rectangular horizontal and vertical deflection coils have horizontal and vertical deflection sensitivities enhanced by approx. 20–30% as the distances between the electron beams and the deflection coils are shorter by a range of 20% compared to the related art circular deflection yokes.

However, the related art CRT deflection yoke 4 has the following problems. First, the circular deflection yoke with the circular deflection coils is unfavorable because of its poor deflection sensitivity due to the unnecessary distance between the electron beams and the deflection coil, and is particularly unfavorable in the case of a wide angle deflection yoke. The wide angle deflection yoke is not applicable to a high definition and high frequency deflection yoke.

Second, the ferrite core 44 used in the RAC type deflection yoke has a shrinkage rate of up to 20%, requiring a fabrication tolerance to be ±2% due to limitations in the fabrication process. Further, the related art ferrite core 44 having a rectangular inside surface for enhancing the sensitivity of the deflection yoke has different inside diameters at left and right sides, the top, and the bottom. As the rectangular ferrite core requires the fabrication tolerance during the fabrication process to be greater than three times that of the existing circular core, and has a rectangular, not circular, inside surface that is difficult to polish for accurate dimensional control, the rectangular ferrite core has the problem that a production yield is around 50% in comparison to the existing circular inside surface core, at around 200% of the cost.

The above references are incorporated by reference herein where appropriate for appropriate teachings of additional or alternative details, features and/or technical background.

SUMMARY OF THE INVENTION

An object of the invention is to solve at least the above problems and/or disadvantages and to provide at least the advantages described hereinafter.

Accordingly, the invention is directed to a deflection yoke in a CRT that substantially obviates one or more of the problems due to limitations and disadvantages of the related art.

Another object of the invention is to provide a deflection yoke in a CRT which permits, not only an improvement in deflection sensitivity and a reduction in inside surface dimensions of the ferrite core, but also provides for easy polishing of the inside surface, thereby significantly improving production yield, and the ferrite core dimensions.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve at least the above objects in whole or in part and in accordance with the purpose of the invention, as embodied and broadly described, a cathode ray tube according to the invention includes a panel having a fluorescent surface comprised of red R, green G, and blue B fluorescent materials, a funnel fitted to a rear of the panel that provides an inner space under vacuum, an electron gun fitted inside of a tubular neck part at a rear of the funnel that emits electron beams, and a deflection yoke that deflects the electron beams in a horizontal or vertical direction, the deflection yoke including horizontal and vertical deflection coils that deflect the electron beams emitted from the electron gun in a horizontal or vertical direction, a ferrite core that reduces a loss of magnetic force caused by the horizontal and vertical deflection coils thereby enhancing magnetic efficiency, and a holder that holds the horizontal deflection coil, the vertical deflection coil, and the ferrite core at required positions, provides insulation between the horizontal and vertical deflection coils, wherein the screen end, or side of the horizontal and/or vertical deflection coil has a substantially rectangular shape and the ferrite core is circular or elliptical.

The horizontal and/or vertical deflection coil may have a circular or elliptical shape on the neck end, or side.

Further, the ferrite core may have a circular or elliptical shape on the screen and neck ends, or sides.

Further, there may a least and a greatest distance between the ferrite core and an opposite deflection coil with reference to a plane perpendicular to a tube axis. The difference between the greatest distance and the least distance may be greatest on a screen side end, or edge.

Furthermore, a difference between the greatest and least distance may become gradually greater starting from a neck end, or side to a screen end, or side.

The least distance is preferably in a range of approximately 0–1.0 mm, and the greatest distance is preferably in a range of approximately 1–30 mm.

To further achieve at least the above objects in whole or in part and in accordance with the purposes of the invention, as embodied and broadly described, a cathode ray tube is provided including a panel having a fluorescent surface, a funnel fitted to rear of the panel and configured to maintain an inner space formed between the panel and funnel in vacuum, an electron gun fitted inside of a neck part of the funnel for emitting electron beams, and a deflection yoke configured to deflect electron beams in a horizontal and/or vertical direction. The deflection yoke includes horizontal and vertical deflection coils configured to deflect the electron beams emitted from the electron gun in a horizontal and/or vertical direction, and a ferrite core configured to reduce a loss of magnetic force caused by the horizontal and vertical deflection coils, thereby enhancing a magnetic efficiency of the cathode ray tube, wherein a screen side of at least one of the horizontal and vertical deflection coils has a substantially rectangular shape, and the ferrite core is circular or elliptical.

Additionally, to achieve at least the above objects in whole or in part and in accordance with the purposes of the invention, as embodied and broadly described, a cathode ray tube is provided including a panel having a fluorescent surface, a funnel fitted to rear of the panel and configured to maintain an inner space formed between the panel and funnel in vacuum, an electron gun fitted inside of a neck part of the funnel for emitting electron beams, and a deflection yoke configured to deflect electron beams in a horizontal and/or vertical direction. The deflection yoke includes horizontal and vertical deflection coils configured to deflect the electron beams emitted from the electron gun in a horizontal and/or vertical direction, and a ferrite core configured to reduce a loss of magnetic force caused by the horizontal and vertical deflection coils, thereby enhancing a magnetic efficiency of the cathode ray tube, wherein there is a least and a greatest distance between the ferrite core and at least one of the horizontal and vertical deflection coils opposite to the ferrite core with reference to a plane perpendicular to a tube axis.

Additionally, to achieve at least the above objects in whole or in part and in accordance with the purposes of the invention, as embodied and broadly described, a deflection yoke is provided including horizontal and vertical deflection coils configured to deflect the electron beams emitted from the electron gun in a horizontal and/or vertical direction, and a ferrite core, wherein a screen side of at least one of the horizontal and vertical deflection coils has a substantially different shape than the ferrite core.

It is to be understood that both the foregoing general description and the following detailed description are exemplary and explanatory and are intended to provide further explanation of the invention as claimed. Additional advantages, objects, and features of the invention will be set forth in part in the description which follows and in part will become apparent to those having ordinary skill in the art upon examination of the following or may be learned from practice of the invention. The objects and advantages of the invention may be realized and attained as particularly pointed out in the appended claims.

BRIEF DESCRIPTION OF THE DRAWINGS

The invention will be described in detail with reference to the following drawings in which like reference numerals refer to like elements. The drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF PREFERRED EMBODIMENTS

Reference will now be made in detail to the embodiments of the invention, examples of which are illustrated in the accompanying drawings.

Figure 1:
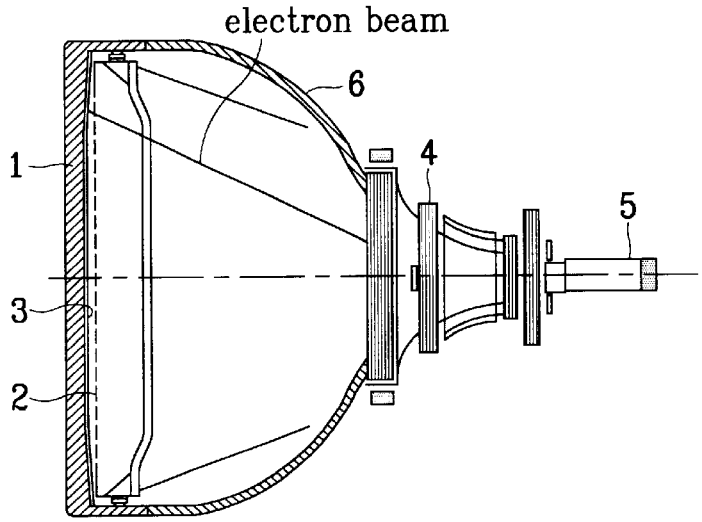
FIG.1 Related Art
FIG. 1 is a schematic side view of a related art CRT.

An in-line type electron gun used in a color CRT generally has red 'R', green 'G', and blue 'B' color electron beams arranged horizontally on a line, and requires a self-converging type deflection yoke to converge the three electron beams onto one point on a fluorescent surface using a non-uniform magnetic field. The invention can be employed in such a color CRT, an example of which is shown in FIG. 1. The color CRT of FIG. 1 includes a panel 1 at a front of the CRT. A fluorescent surface 3 having red R, green G, and blue B fluorescent materials is coated on an inside surface of the panel. A shadow mask 2 is positioned at a rear side of the fluorescent surface and selects a color of the electron beams incident on the fluorescent surface. A funnel 6 is fitted to a rear of the panel 1 and provides an inner space in vacuum. An electron gun 5 is fitted inside of a tubular neck part of the funnel 6 at a rear of the panel 1 and emits electron beams. A deflection yoke 4 fitted around an outer circumference of the funnel 6 deflects the electron beams in a horizontal or vertical direction.

Figure 8:
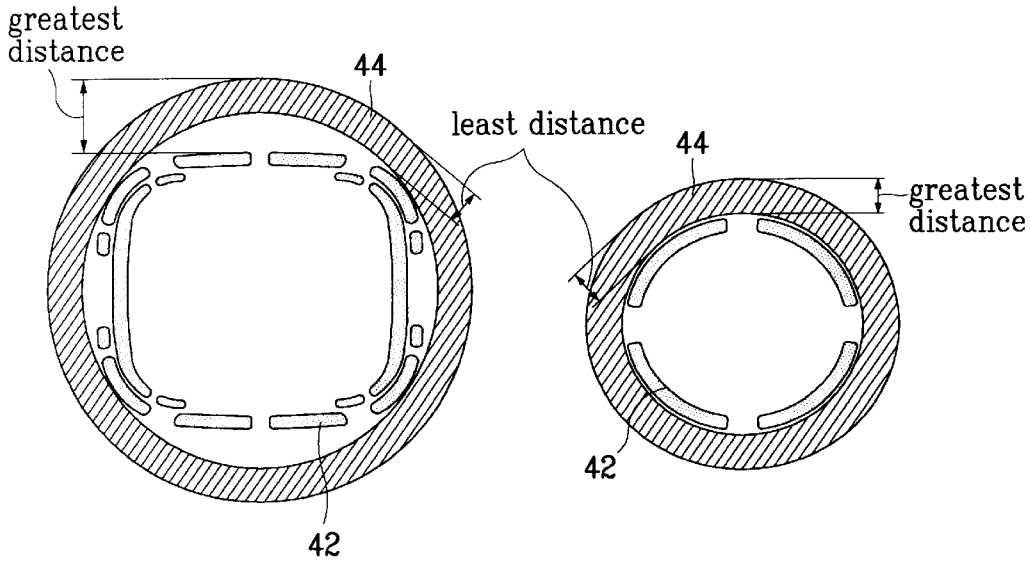
FIG. 8 is a schematic drawing of a section of a RTC type deflection yoke in accordance with an embodiment of the invention.
Figure 9:
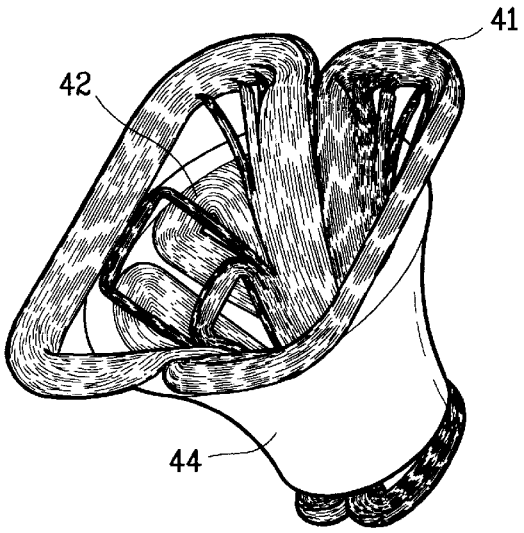
FIG. 9 is a schematic perspective view of a RTC type deflection yoke in accordance with an embodiment of the invention.

Referring to FIGS. 8 and 9, the deflection yoke 4 is provided with one pair of horizontal deflection coils 41 that deflect the electron beams emitted from the electron gun 5 in a horizontal direction, one pair of vertical deflection coils 42 that deflect the electron beams in a vertical direction, and a ferrite core 44 that reduces a loss of magnetic force caused by currents in the horizontal and vertical deflection coils 41, 42. A holder 43, similar to that shown in FIG. 2, fixes the physical relative positions, fastens, and couples the horizontal deflection coils, the vertical deflection coils, and the ferrite core, provides insulation between the horizontal and vertical deflection coils, and facilitates coupling of the deflection yoke 4 to the CRT.

Figure 2:
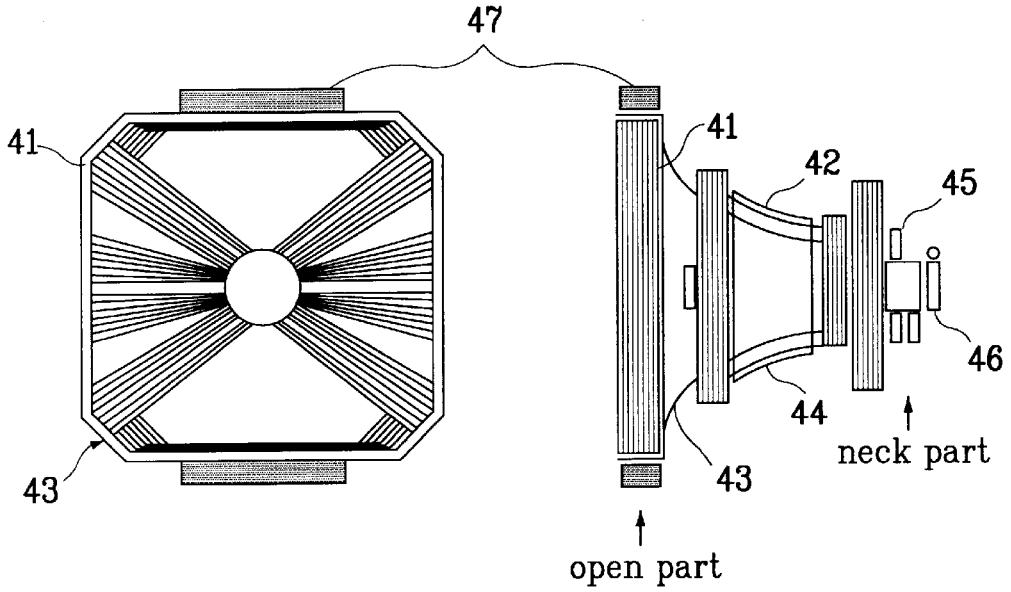
FIG.2 Related Art
FIG. 2 is a schematic side view of a related art deflection yoke.

A COMA free coil 45 is fitted to a neck side of the holder, similar to that shown in FIG. 2, which improves a COMA aberration caused by a vertical barrel type magnetic field. A ring band 46, similar to that shown in FIG. 2, is fitted to a neck side of the holder 43 and mechanically couples the CRT with the deflection yoke 4. Magnets 47 are fitted to an open end of the deflection yoke 4. The magnet 47 correct raster distortion (hereafter "distortion") on the picture.

Figure 13:
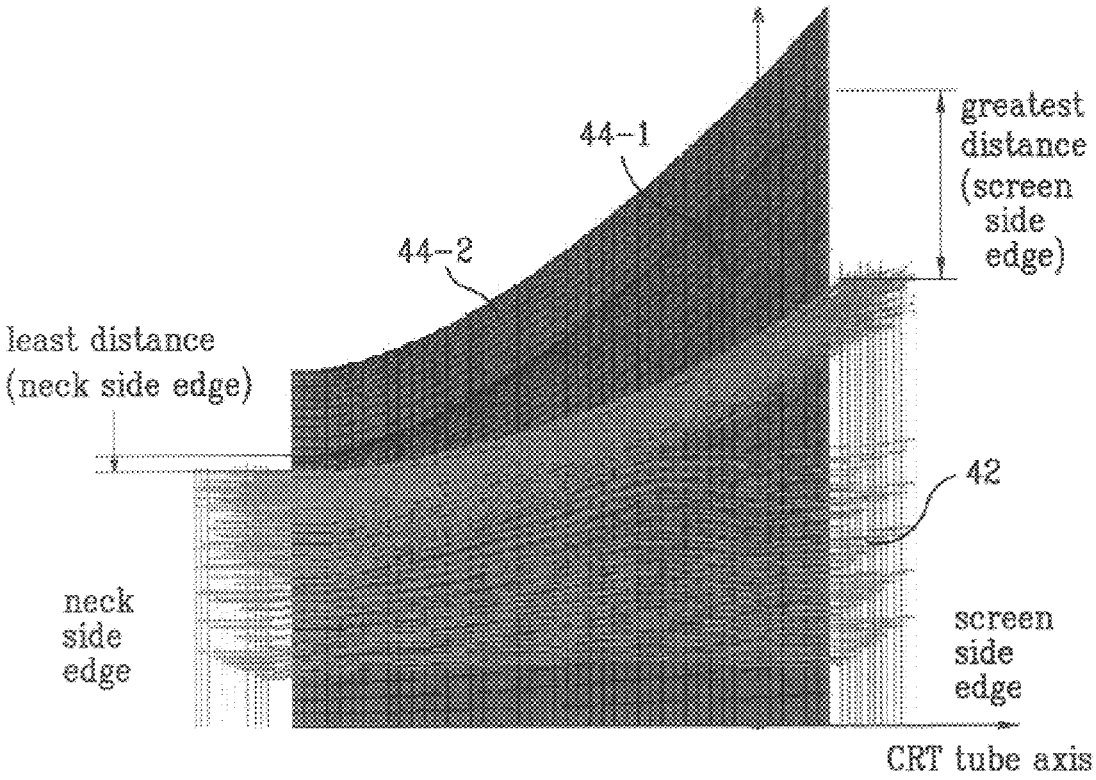
FIG. 13 is a schematic drawing of an assembly of a vertical deflection coil and a ferrite core in accordance with an embodiment of the invention.

The deflection yoke 4 (hereafter "RTC (Round-Core Tetra Coil-Combined) deflection yoke") according to the invention includes rectangular horizontal and vertical deflection coils 41, 42, as shown in FIGS. 8 and 9, and a ferrite core 44 formed such that a distance between the ferrite core and the deflection coil opposite thereto is greatest and least at points as shown in FIGS. 8 and 13.

The difference between the greatest distance and the least distance is configured to be largest on a screen side edge of the ferrite core, for reducing convergence and distortion errors caused by deviation of an inside surface dimension of the rectangular ferrite core, saving material costs, and improving deflection sensitivity of the ferrite core.

As shown in FIGS. 8, 9, 11A, 11B, 12, and 13, the RTC type deflection yoke according to the invention includes rectangular horizontal and vertical deflection coils, having an improved deviation of inside surface dimensions and ferrite core deflection sensitivity, and a ferrite core 4 formed such that an inside surface thereof has greatest and least distances to a deflection coil 42 opposite thereto on a plane perpendicular to a tube axis of the ferrite core. The difference between the greatest distance and the least distance is greatest at a screen side edge of the ferrite core. That is, as shown in FIG. 13, the ferrite core 4 is formed such that a ratio of increase of the greatest distance increases gradually from a minimum of approximately 0% at the neck side edge, or end of the ferrite core to a maximum of approximately 6000% at the screen side edge, or end with reference to the neck side edge, or end of the ferrite core 4.

Referring to FIG. 8, though the least distance at the screen side edge of the deflection coil is fixed at a ratio in a range of approximately 0–1 mm with reference to a plane perpendicular to the tube axis, the ferrite core 4 is formed such that the greatest distance between the vertical deflection coil and an inside surface of the ferrite core is in a range of approximately 1 mm–30 mm.

The foregoing RTC type deflection yoke has the following differences from the circular deflection yoke 4 and the RAC type deflection yoke 4 discussed in the "Background of the Related Art" section of the application. The circular deflection yoke has a deflection sensitivity improvement in a range of approximately 20–30% over the RAC type deflection yoke, because the deflection sensitivity of the deflection yoke is inversely proportional to a third power of a distance between the deflection coil and the electron beams, and the rectangular deflection coil has a distance between the deflection coil and the electron beams approx. 20% shorter than the circular deflection coil.

However, because both the deflection coil and the ferrite core in the related art RAC type deflection yoke are rectangular, the related art RAC type deflection yoke has various disadvantages, such as convergence and distortion errors on the screen resulting from dimensional deviation of the inside surface of the ferrite core from the electron beams, high cost, and the like.

The RTC type deflection yoke according to the invention in comparison to the related art circular deflection yoke has a significantly different deflection center of the horizontal deflection coils. That is, though inside surface areas of the neck parts of the two types of deflection yokes are similar, since the inside surface area of the circular deflection yoke in a zone from a point where the non-circular form starts to the opening is at least 10 times that of the neck part area and the inside surface area of the RTC deflection yoke in a similar zone is at least 4 times that of the neck part area, a deflection center of the horizontal deflection coil of the RTC type deflection coil shifts toward the screen compared to the circular deflection coil. Once the deflection center shifts toward the screen, as the BSN characteristic, a phenomenon where the electron beams from the electron gun strike the inside surface of the panel, is lengthened a few mm compared to the related art, the horizontal deflection coil can be moved toward the neck by approx. 1–10 mm. The same phenomenon occurs for the vertical deflection coil. Therefore, once the horizontal and vertical deflection coils are shifted toward the neck side, the ferrite core is also required to be shifted toward the neck side.

The foregoing RTC type deflection yoke according to the invention has the following differences when compared to the related art circular deflection yoke. Once the horizontal and vertical deflection coils are shifted toward the neck side, since a magnetic flux density per unit area becomes higher, which improves a deflection force for deflecting the electron beams, the deflection sensitivity is improved. This is in addition to the improved deflection sensitivity obtained by changing the deflection coil from circular to rectangular. Further, the shift of the ferrite core of the invention toward the neck side by approximately 1–10 mm compared to the related art circular deflection yoke allows the ferrite core to be configured smaller and also reduces the screen side area in comparison to the neck area, which provides savings in material costs.

In comparing the RTC type deflection yoke according to the invention to the related art RTC deflection yoke, though both the horizontal and vertical deflection yokes are rectangular, identical in shape, the ferrite core of the RTC type according to the invention is circular, while the ferrite core of the RAC type of the related art is rectangular.

Figure 10:
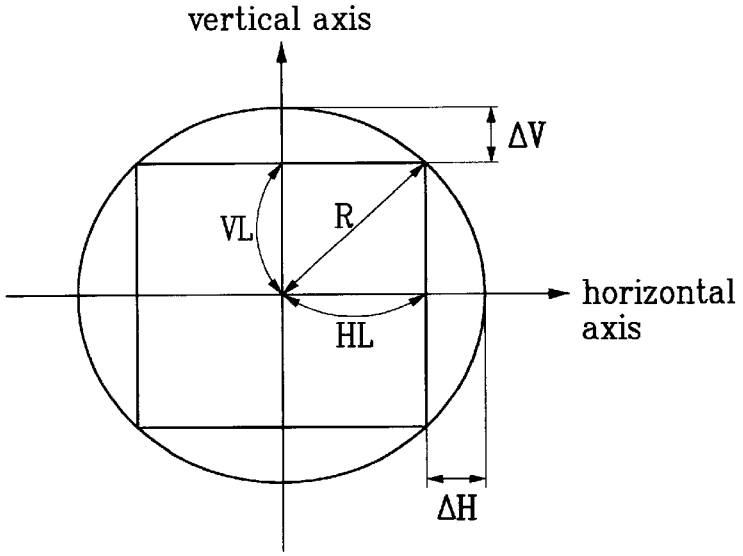
FIG. 10 is a schematic diagram representing a section of a funnel part of a CRT.
Figure 11A:
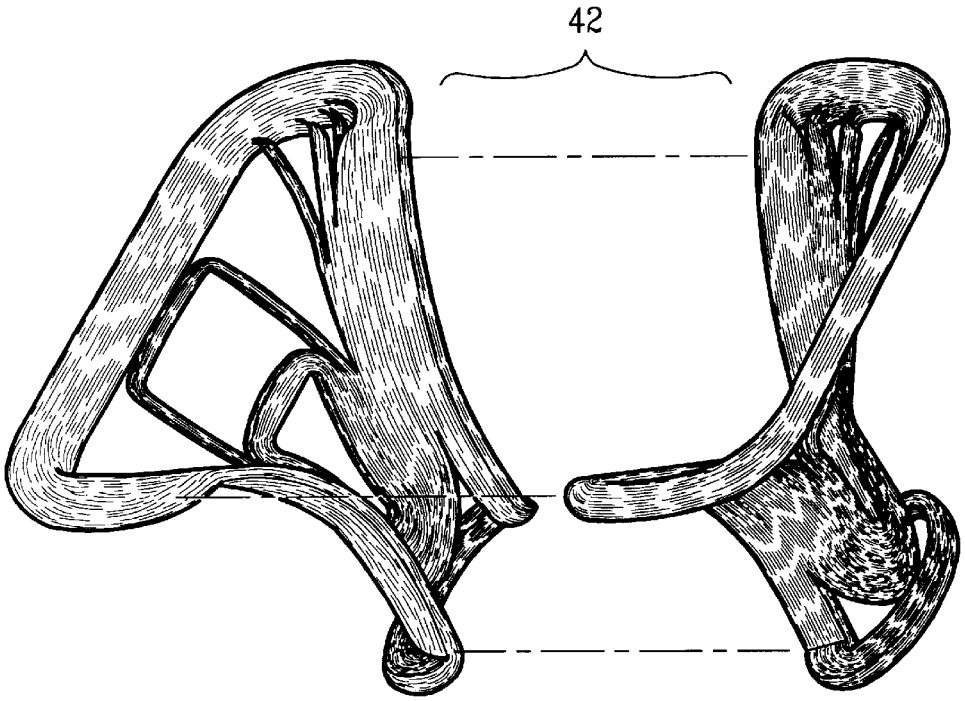
FIGS. 11A and 11B are schematic drawings of a vertical deflection coil according to an embodiment of the invention before and after assembly.
Figure 11B:
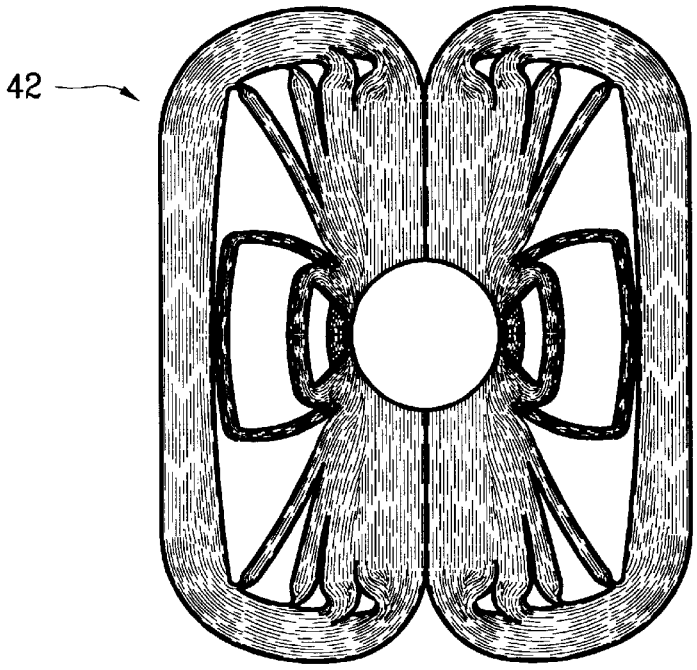
Figure 12:
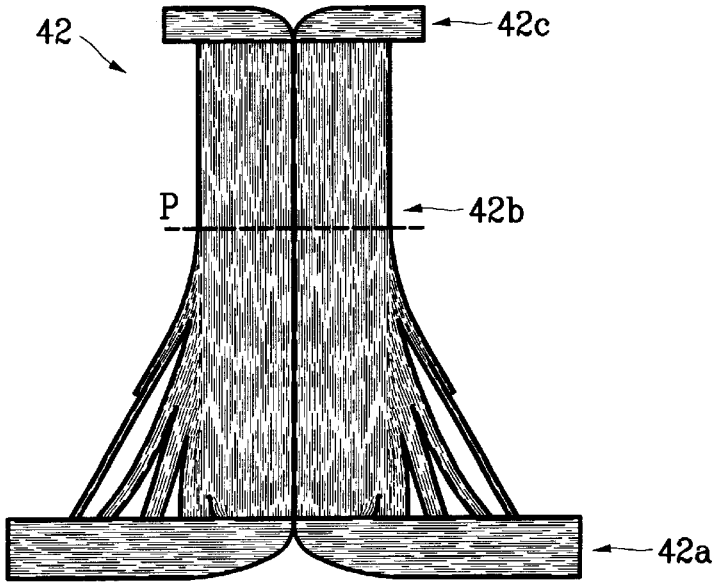
FIG. 12 is a schematic drawing of a vertical deflection coil assembly according to an embodiment of the invention.

FIG. 10 illustrates a section of a funnel on which a deflection yoke of a CRT is fitted. The yoke is formed to fit to the circular neck part and the rectangular screen side of the vertical deflection coil.

Figure 3A:
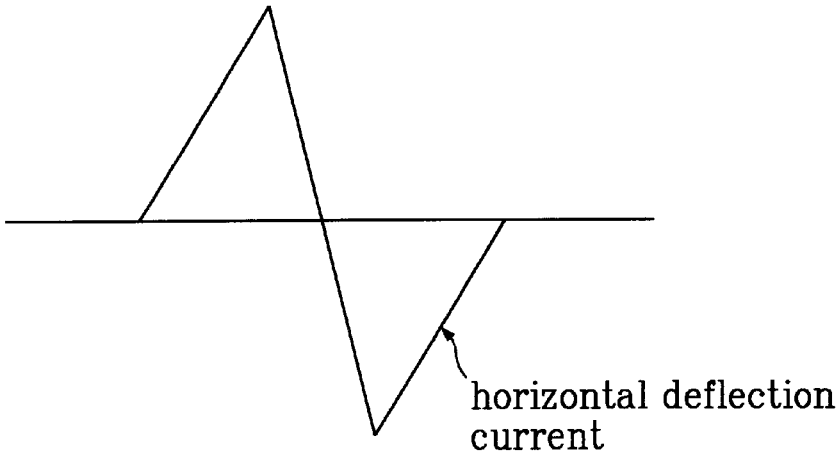
FIG.3A Related Art
FIGS. 3A and 3B are schematic diagrams representing a horizontal deflection current applied to a related art deflection yoke and a horizontal deflection circuit, respectively.
Figure 3B:
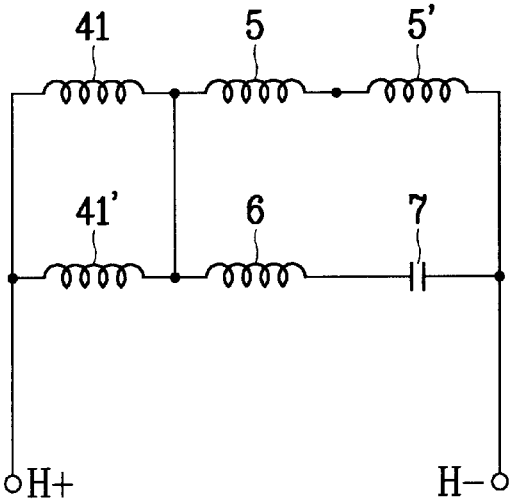
FIG.3B Related Art
Figure 4:
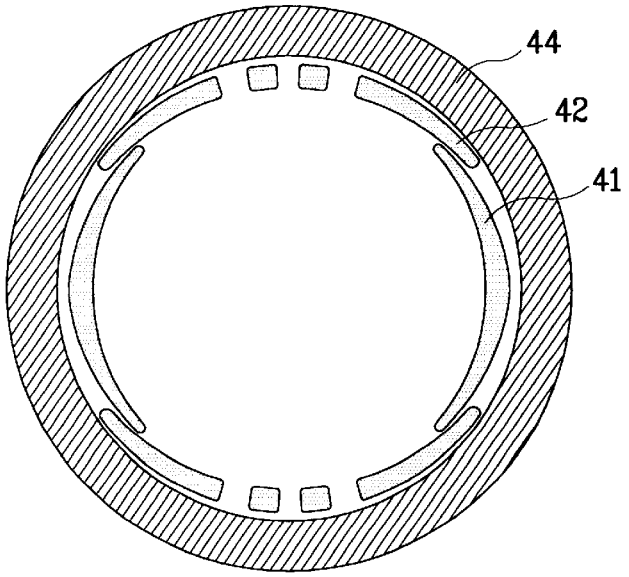
FIG. 4 Related Art
FIG. 4 is a schematic drawing of a section of a related art circular deflection yoke.
Figure 5:
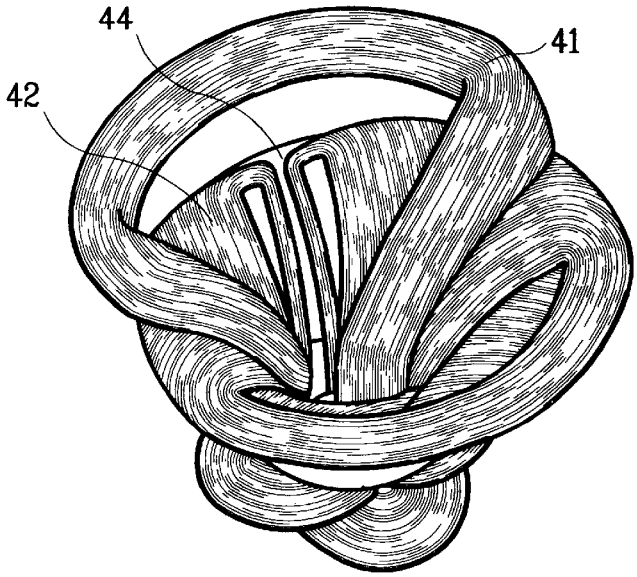
FIG. 5 Related Art
FIG. 5 is a schematic perspective view of a related art circular deflection yoke.
Figure 6:
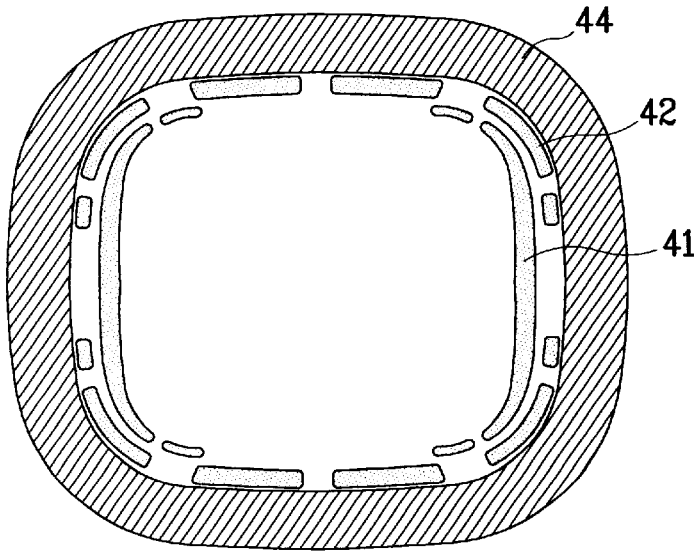
FIG. 6 Related Art
FIG. 6 is a schematic drawing of a section of a related art RAC type deflection yoke.
Figure 7:
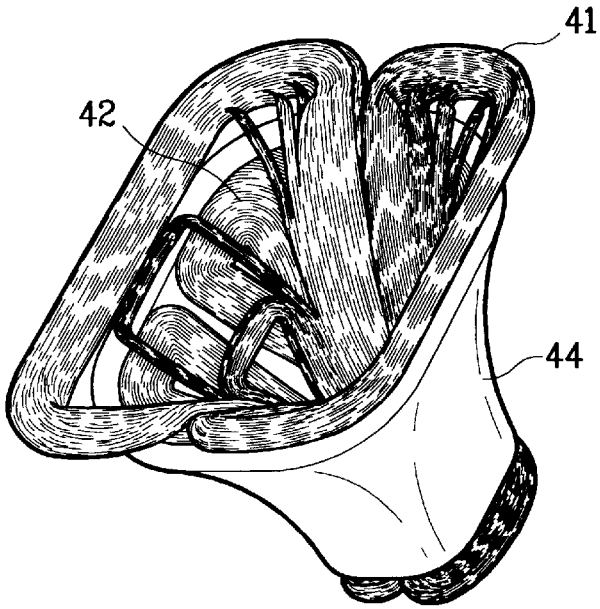
FIG. 7 Related Art
FIG. 7 is a schematic perspective view of a related art RAC type deflection yoke.

The RTC type deflection yoke according to the invention has a horizontal deflection sensitivity Ph similar to the related art RAC type deflection yoke, as expressed by equation (1) as follows:

$$Ph=Lh*Ih^2\text{peak-peak} \quad (1)$$

where, Ph denotes a deflection sensitivity of the horizontal deflection coil, Lh denotes an inductance of the horizontal deflection coil, and $Ih^2$peak–peak denotes a peak to peak value of a deflection current through the horizontal deflection coil, as shown in FIG. 3. If the ferrite core is changed from a rectangular form to a circular form, though the horizontal deflection current Ih increases, an inductance Lh of the horizontal deflection coil decreases and, the horizontal deflection sensitivity is kept almost the same.

The RTC type deflection yoke according to the invention can reduce the convergence and distortion errors resulting from the dimensional deviation of the inside surface of the rectangular ferrite core 44 of the related art RAC type deflection yoke, and can save material costs of the ferrite core. Moreover, as shown in FIG. 8, the ferrite core of the invention is circular, i.e., an inside surface diameter is constant, which facilitates high precision polishing of the inside surface below an inside surface variation of approximately 0.02 mm. Further, the invention permits high definition ferrite characteristics, and improves production yield by approximately 3 times compared to related art rectangular ferrite cores.

As has been explained, the RTC type deflection yoke according to the invention has the following advantages.

First, while the related art ferrite core in the RAC type deflection yoke is difficult to polish, because an inside surface thereof is rectangular, has a large dimensional distribution of the inside surface as the inside surface radius is different on horizontal and vertical axes, and has low yield, high material cost, and high production cost, the RTC type ferrite core with a circular inside surface according to the invention provides a reduced inside surface dimensional distribution of the ferrite core by more than ½, and provides for easy polishing of the inside surface in the case of a deflection yoke that require high precision, thereby increasing production yield, significantly improving the dimensional distribution of the ferrite core, reducing material costs by more than ⅓, and improving convergence and distortion errors of the deflection yoke.

Second, the combination of the rectangular deflection coil and the shift of the deflection yoke toward a neck side by approximately 1–10 mm compared to the related art circular deflection yoke according to the invention improves deflection sensitivity by approximately 20–30% compared to the circular deflection yoke.

The foregoing embodiments and advantages are merely exemplary and are not to be construed as limiting the present invention. The present teaching can be readily applied to other types of apparatuses. The description of the present invention is intended to be illustrative, and not to limit the scope of the claims. Many alternatives, modifications, and variations will be apparent to those skilled in the art. In the claims, means-plus-function clauses are intended to cover the structures described herein as performing the recited function and not only structural equivalents but also equivalent structures.

What is claimed is:

1. A cathode ray tube (CRT), comprising:

a panel having a fluorescent surface comprising red R, green G, and blue B fluorescent materials;

a funnel fitted to a rear of the panel for maintaining an inner space in vacuum;

an electron gun fitted inside of a tubular neck part at a rear of the funnel for emitting electron beams; and a deflection yoke for deflecting the electron beams in a horizontal and/or vertical direction, the deflection yoke including:

horizontal and vertical deflection coils for deflecting the electron beams emitted from the electron gun in a horizontal and/or vertical direction;

a ferrite core for reducing a loss of magnetic force caused by the horizontal and vertical deflection coils to enhance a magnetic efficiency; and a holder for holding the horizontal deflection coil, the vertical deflection coil, and the ferrite core at required positions, and providing insulation between the horizontal and vertical deflection coils, wherein a screen side of the horizontal and/or vertical deflection coil has a substantially rectangular shape, and the ferrite core is circular or elliptical.

2. The cathode ray tube as claimed in claim 1, wherein the horizontal and/or vertical deflection coil has a circular or elliptical neck part.

3. The cathode ray tube as claimed in claim 1, wherein the ferrite core has circular or elliptical shape on a screen side and on a neck side.

4. The cathode ray tube as claimed in claim 1, wherein there is a least and a greatest distance between the ferrite core and an opposite deflection coil with reference to a plane perpendicular to a tube axis.

5. The cathode ray tube as claimed in claim 4, wherein a difference between the least distance and the greatest distance is largest at a screen side edge.

6. The cathode ray tube as claimed in claim 4, wherein a difference between the least distance and the greatest distance becomes gradually greater starting from a neck side edge to a screen side edge.

7. The cathode ray tube as claimed in claim 5, wherein a difference between the least distance and the greatest distance becomes gradually greater starting from a neck side edge to a screen side edge.

8. The cathode ray tube as claimed in claim 4, wherein the least distance is in a range of approximately 0–1.0 mm, and the greatest distance is in a range of approximately 1–30 mm.

9. A cathode ray tube (CRT), comprising:

a panel having a fluorescent surface;

a funnel fitted to rear of the panel and configured to maintain an inner space formed between the panel and funnel in vacuum;

an electron gun fitted inside of a neck part of the funnel for emitting electron beams; and a deflection yoke configured to deflect electron beams in a horizontal and/or vertical direction, the deflection yoke including;

horizontal and vertical deflection coils configured to deflect the electron beams in a horizontal and/or vertical direction; and a ferrite core, wherein a screen side of at least one of the horizontal and vertical deflection coils has a substantially different shape than the ferrite core.

10. The cathode ray tube as claimed in claim 9, wherein a screen side of at least one of the horizontal and vertical deflection coils has a substantially rectangular shape, and the ferrite core is circular or elliptical.

11. The cathode ray tube as claimed in claim 9, further comprising a holder configured to hold the horizontal deflection coil, the vertical deflection coil, and the ferrite core at required positions, and providing insulation between the horizontal and vertical defection coils.

12. The cathode ray tube as claimed in claim 11, wherein the at least one of the horizontal and vertical deflection coils has a circular or elliptical neck part.

13. The cathode ray tube as claimed in claim 11, wherein the ferrite core has a circular or elliptical shape on a screen side and a neck side.

14. The cathode ray tube as claimed in claim 11, wherein there is a least and a greatest distance between the ferrite core and at least one of the horizontal and vertical deflection coils opposite to the ferrite core with reference to a plane perpendicular to a tube axis.

15. The cathode ray tube as claimed in claim 14, wherein a difference between the least distance and the greatest distance is largest at a screen side edge.

16. The cathode ray tube as claimed in claim 14, wherein a difference between the least distance and the greatest distance becomes gradually greater starting from a neck side edge to a screen side edge.

17. The cathode ray tube as claimed in claim 15, wherein a difference between the greatest distance and the least distance becomes gradually greater starting from a neck side edge to a screen side edge.

18. The cathode ray tube as claimed in claim 14, wherein the least distance is in a range of approximately 0–1.0 mm, and the greatest distance is in a range of approximately 1–30 mm.

19. The cathode ray tube as claimed in claim 10, wherein the cathode ray tube is a color cathode ray tube.

20. The cathode ray tube as claimed in claim 10, wherein the fluorescent surface comprises red R, green G, and blue B fluorescent materials.

21. A cathode ray tube (CRT), comprising:

a panel having a fluorescent surface;

a funnel fitted to rear of the panel and configured to maintain an inner space formed between the panel and funnel in vacuum;

an electron gun fitted inside of a neck part of the funnel for emitting electron beams; and a deflection yoke configured to deflect electron beams in a horizontal and/or vertical direction, the deflection yoke including:

horizontal and vertical deflection coils configured to deflect the electron beams emitted from the electron gun in a horizontal and/or vertical direction; and a ferrite core configured to reduce a loss of magnetic force caused by the horizontal and vertical deflection coils, thereby enhancing a magnetic efficiency of the cathode ray tube, wherein there is a least and a greatest distance between the ferrite core and at least one of the horizontal and vertical deflection coils opposite to the ferrite core with reference to a plane perpendicular to a tube axis.

22. The cathode ray tube as claimed in claim 21, wherein a difference between the least distance and the greatest distance is largest at a screen side edge.

23. The cathode ray tube as claimed in claim 21, wherein a difference between the least distance and the greatest distance becomes gradually greater starting from a neck side edge to a screen side edge.

24. The cathode ray tube as claimed in claim 21, wherein the least distance is in a range of approximately 0–1.0 mm, and the greatest distance is in a range of approximately 1–30 mm.

* * * * *